US007336269B2

(12) United States Patent
Huang et al.

(10) Patent No.: US 7,336,269 B2
(45) Date of Patent: Feb. 26, 2008

(54) ELECTRONIC DISCHARGING CONTROL CIRCUIT AND METHOD THEREOF FOR LCD

(75) Inventors: Hsin-Chung Huang, Taipei County (TW); Juin-Ying Huang, Taoyuan County (TW); I-Cheng Chen, Changhua County (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 595 days.

(21) Appl. No.: 10/711,543

(22) Filed: Sep. 24, 2004

(65) Prior Publication Data

US 2006/0066550 A1 Mar. 30, 2006

(51) Int. Cl.
*G09G 3/30* (2006.01)

(52) U.S. Cl. ..... 345/204; 345/76; 345/87; 345/102; 345/212; 315/169.3

(58) Field of Classification Search ..... 345/76, 345/87, 92, 204, 205, 212, 690; 315/160, 315/162, 169.3, 182
See application file for complete search history.

(56) References Cited

U.S. PATENT DOCUMENTS 5,248,963 A 9/1993 Yasui et al.
2002/0158587 A1* 10/2002 Komiya ..... 315/169.3
2003/0234780 A1* 12/2003 Hsieh et al. ..... 345/212
2004/0147113 A1* 7/2004 Yamazaki et al. ..... 438/660
2004/0169665 A1* 9/2004 Sakashita et al. ..... 345/629
2004/0179315 A1* 9/2004 Iwasaki ..... 361/92
2004/0183772 A1* 9/2004 Nakajima et al. ..... 345/102
2006/0097965 A1* 5/2006 Deane et al. ..... 345/76

FOREIGN PATENT DOCUMENTS

CN 1183604 6/1998

* cited by examiner

*Primary Examiner*—Bipin Shalwala
*Assistant Examiner*—Vincent E. Kovalick
(74) *Attorney, Agent, or Firm*—Jianq Chyun IP Office

(57) ABSTRACT

A control circuit and a method discharging capacitor/transistor, for a liquid crystal display (LCD), are provided. The control circuit includes a signal-off detector and an all-gate-on delay cell. When an LCD power-off signal is detected, a first control signal is transmitted to a power supply module for turning off power except the gate-on voltage, and turning off VGH after a specific delay time. A second control signal is also transmitted to the gate-on-delay cell, so that all gates of the pixel transistors are turned on after a second specific delay time. The charges on the pixel transistor are discharged via a source thereof before the gate-on voltage decreases below a threshold value, such that a residual image phenomenon caused by heterogeneous filming fabrication is reduced.

14 Claims, 5 Drawing Sheets

ELECTRONIC DISCHARGING CONTROL CIRCUIT AND METHOD THEREOF FOR LCD

BACKGROUND OF THE INVENTION

1. Field of the Invention

The present invention relates to a discharging control circuit, and more particularly, to a control circuit for electronic discharging using energy storing device to reduce the residual image phenomenon of an LCD.

2. Description of Related Art

In a thin film transistor fabricating process, the major steps include coating photoresist (PR), exposure, development, film deposition and etching. Wherein the step of coating PR includes loading a glass substrate to a spinner, yet this method results in thinner PR around central area than that around the peripheral of the glass substrate, therefore during the etching step, for example, a back channel etching (BCE), the etching rate around the central area of the glass substrate is faster than that around the peripheral. Thus, an off-leakage current of a TFT is lower. Accordingly, the off-leakage current of a TFT varies according to its location on the substrate, thus the speed of discharging the pixel capacitor varies depending on the location on the substrate. Therefore, pixel capacitors originally located around central area of the glass substrate require longer time to discharge.

Referring to FIG. 1, a schematic diagram of a conventional LCD panel fabricated on a glass substrate using TFT fabrication technology is shown. As shown, the LCD panel 100 is divided into four blocks, the structure of the upper right block 102 is described as an example. An area referenced by numeral 110, hereinafter area 110, indicates a rough border between high and low channel turn-off leakage current of a pixel transistor. When the power is off, since it takes longer time for discharging the transistors located in the area 110, it takes longer time for the image to diminish from the corresponding pixels. From a user's point of view, a residual image phenomenon resembling an ebb tide is investigated, and a dynamic subsidence direction is shown as the arrow in block 102 in FIG. 1.

Moreover, the thin film transistor fabricating process for an LCD usually results in a difference from $10^5$ to $10^6$ times between a turn-on current $I_{on}$ and a turn-off current $I_{off}$ corresponding to a gate of the transistor. For example, when a gate potential of a turned-on transistor is 24 V, $I_{on}$ is in the order of μA, whereas when the gate potential of a turned-off transistor is −6V, $I_{off}$ is in the order of pA. When the gate of the transistor is in off state, since $I_{off}$ is far smaller than $I_{on}$, for a high-resolution display panel, it is more often to observe residual image phenomenon. In other words, since film thickness as well as capacitance of transistors are different, when the power supply is turned off, the time required for discharging is different and also the time required for liquid crystals thereof to twist back to original position is different. Therefore, residual image phenomenon is observed on the panel. Meanwhile, the TFTs are switched to an off state, and pixel capacitors are discharged merely via data scanning line, and the $I_{off}$ is in the order of pA as mentioned above, slow discharging is relatively obvious and uneven with respect to persistence in the eyes of a viewer. That is, residual image phenomenon, resembling the tide, is observed. This specific phenomenon cannot be improved by merely rising $I_{off}$, since rising $I_{off}$ in the specifications of a TFT would deficit other characteristics of an image, e.g. flickering phenomenon. Therefore, in order to eliminate residual image phenomenon, one of the efficient solutions is to elaborate on circuit design thereof.

Referring to FIG. 2A, a schematic diagram of a circuit 200 pulling gate potential of a transistor to ground level GND in power off-state is illustrated. The circuit pulls the gate potential to ground level more rapidly using an energy storage device. Referring to FIGS. 2B and 2C, differential temporal response for gate potential using different circuit designs is observed. However, along with the mechanism according to conventional art, gate potential is rapidly pulled to ground level GND only when TFT is switched off. If TFT turned-on threshold voltage does not effectively switch on the gate of the TFT, a tide phenomenon is still observed. Therefore, it is necessary to have a novel integrated circuit for discharging pixel capacitance as well as pulling down gate potential even when power supply is off, such that the tide phenomenon of an LCD panel can be reduced.

SUMMARY OF THE INVENTION

According to the above descriptions, the present invention is directed to a control circuit for an LCD panel capable of reducing the residual image when TFT fails to provide an effective discharging path when the LCD panel is in an off state.

The present invention is directed to a control circuit, integrated into an applied specific integrated circuit (ASIC) of the LCD panel, for controlling the time when a TFT is turned on, and when gates of all TFTs of the LCD panel are turned on. Thus a transistor turn-on potential is high enough to turn on the TFTs for discharging pixels of the LCD panel, thereby reducing the residual image.

According to an embodiment of the present invention, the control circuit is provided for reducing the residual image in an LCD panel, wherein a built-in signal-off detector is used in an ASIC for detecting control signals. When the signal-off detector fails to detect signals outputted from a host control unit, the system is determined to be at an off state, and an all-gate-on signal is low level enable, such that gates of all TFTs of the panel are turned on. Charges stored in the liquid crystal are released via source terminal of the TFT with the circuit, so as to be neutralized by charges in storage capacitor and other energy storing devices of the pixel.

According to an embodiment of the present invention, the control circuit is disposed with an ASIC of an LCD panel, wherein the control circuit includes a signal detecting device and a gate delay unit. The signal detecting device is coupled to a host control unit providing two low level enable signals, wherein one is power enable signal DC_DC.ENA coupled to a switch of the power input to switch off the input potential and a VGH delay unit such that the power is turned off by VGH after a delay time for retaining a turn-on threshold voltage of the gate of the TFT. Other voltage sources provided by the power supply, e.g. analog voltage source, a turn-off voltage level for transistor, and a common voltage source, are assigned to be turned off when DC_DC.ENA is generated. The signal detecting unit also transmits an all-gate-on signal for turning on gates of all TFTs, and determining an action time after a specific time interval when DC_DC.ENA is generated by a gate delay unit.

In a general LCD panel system, a normal power-off procedure follows the steps of turning off the back light module, the signal providing module, and the power supply module. As to the power-off timing in the present invention, the steps are operated as follows. When the signal DC_DC.ENA is generated, the analog voltage source VDDA, the gate scanning line voltage source VEEG and a common voltage source Vcom are all turned off, which are decayed to ground voltage level GND with time. Moreover, in order to turn on gates of all TFTs, VGH turn-off time is delayed such that voltage level is high enough for switching on the gates. A time difference between VGH and DC_DC.ENA is determined by a VGH delay unit. The time to turn on all gates is after VDDA is reduced to GND, and transistors discharge via source terminal path thereof to achieve rapid electronic charge neutralization. The time to turn on all gates should be no later than when VGH reaches a minimum threshold voltage for switching on gates of the TFT.

According to the above descriptions, control circuit can be integrated into the ASIC module of the LCD panel for reducing residual image. Since built-in circuits of ASIC is cooperated with outer circuits, routing layout and associated devices are spared, and fabrication cost is thus reduced. The control circuit, according to the present invention is able to control the time to turn on VGH, and the time to turn on all gates, such that VGH manages to retain a level turning on TFTs within the time window after the power to the panel is turned off, and thus residual image is effectively reduced. Therefore, without modifying the fabricating process, residual image resulted from various characteristics of transistors of TFTs distributed in different area of the panel is effectively reduced by using the control circuit according to the present invention.

DESCRIPTION OF THE EMBODIMENTS

Figure 1:
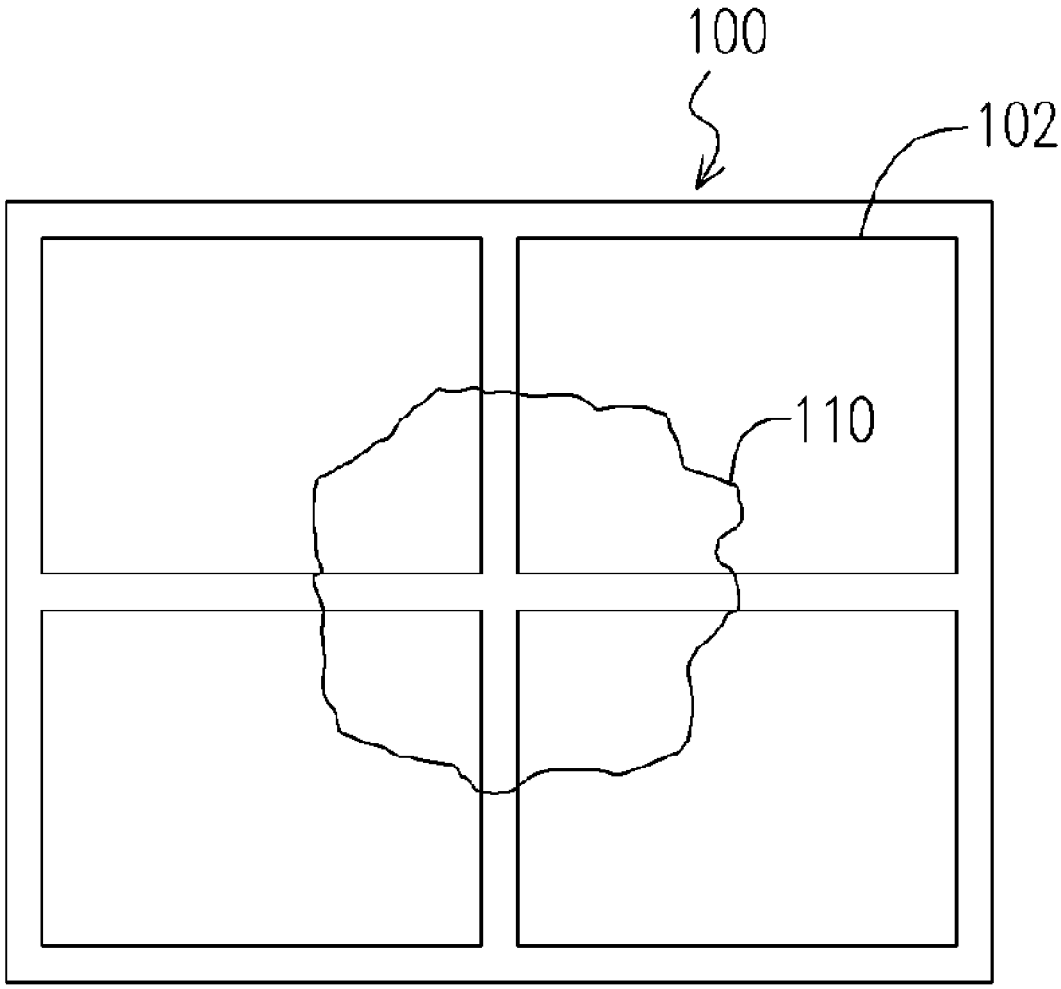
FIG. 1 (PRIOR ART)
FIG. 1 is a schematic block diagram illustrating residual image phenomenon of a TFT LCD according to conventional art.
Figure 2A:
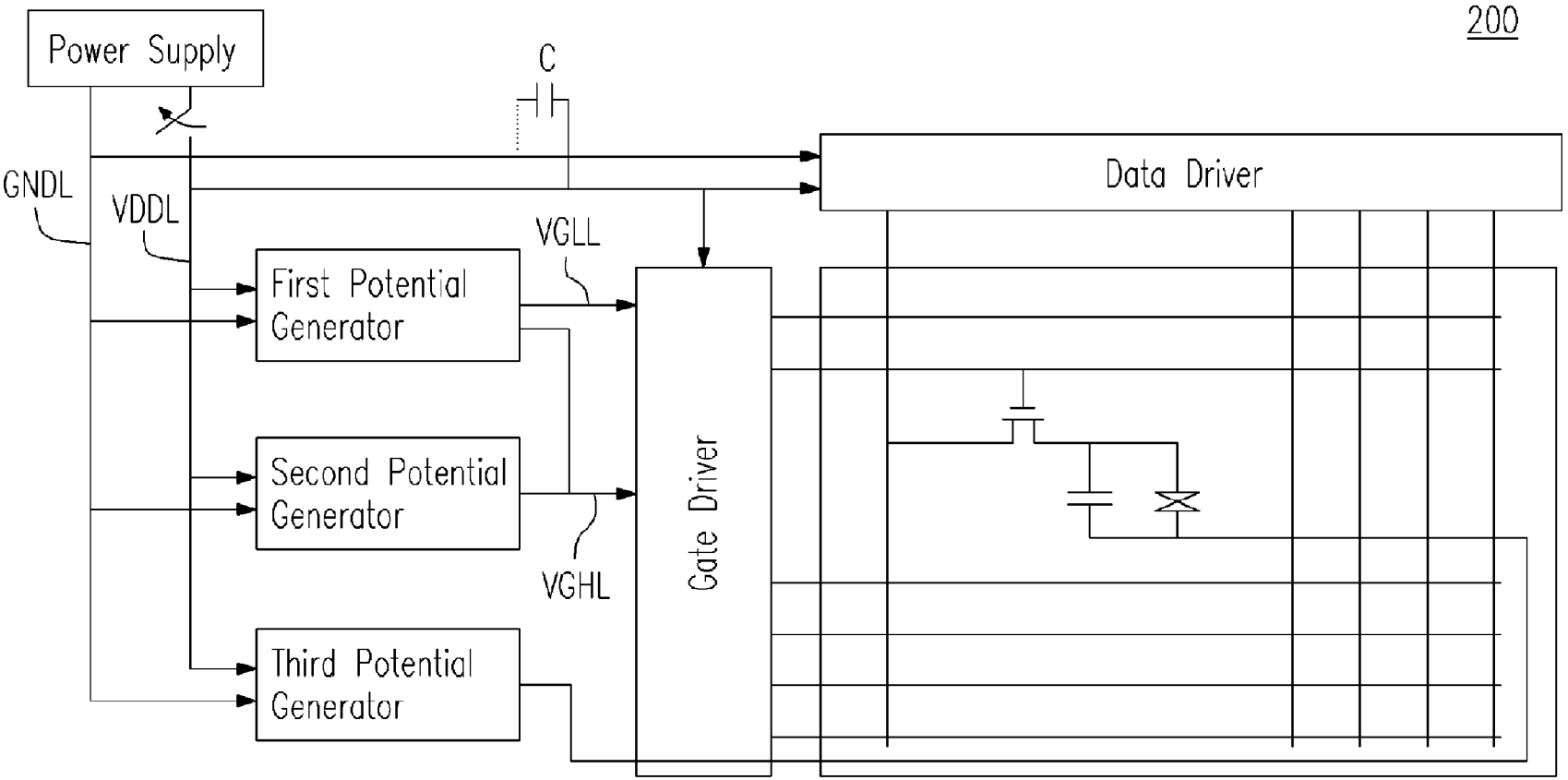
FIG. 2A (PRIOR ART)
FIG. 2A is a schematic diagram illustrating control circuit according to conventional art.
Figure 2B:
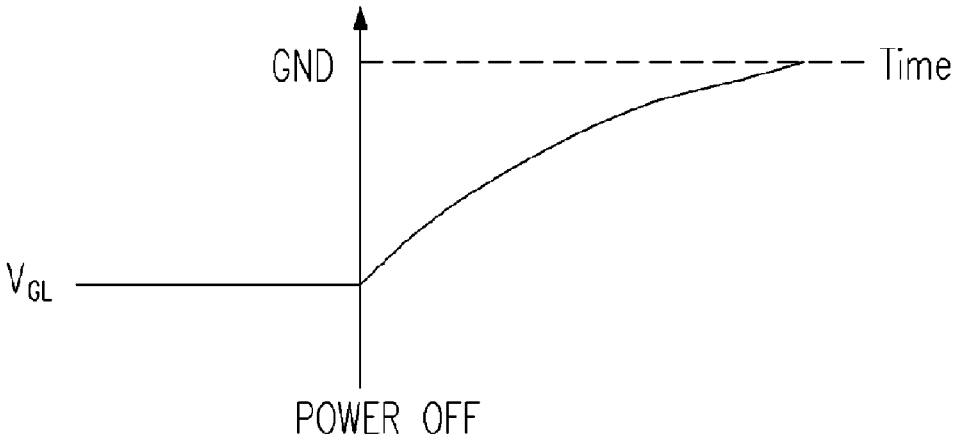
FIG. 2B (PRIOR ART)
FIG. 2B is a schematic diagram illustrating discharging profile according to conventional art.
Figure 2C:
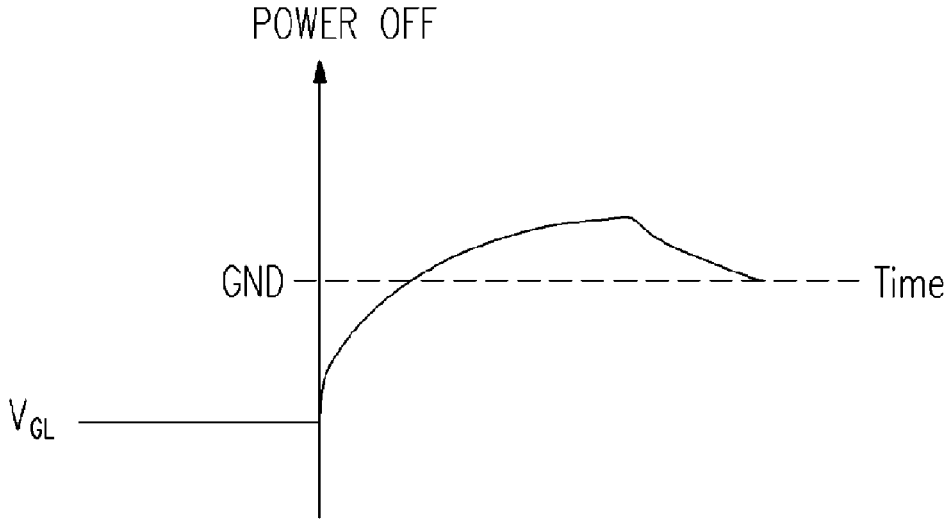
FIG. 2C (PRIOR ART)
FIG. 2C is a schematic diagram illustrating rapid discharging profile according to conventional art.
Figure 3:
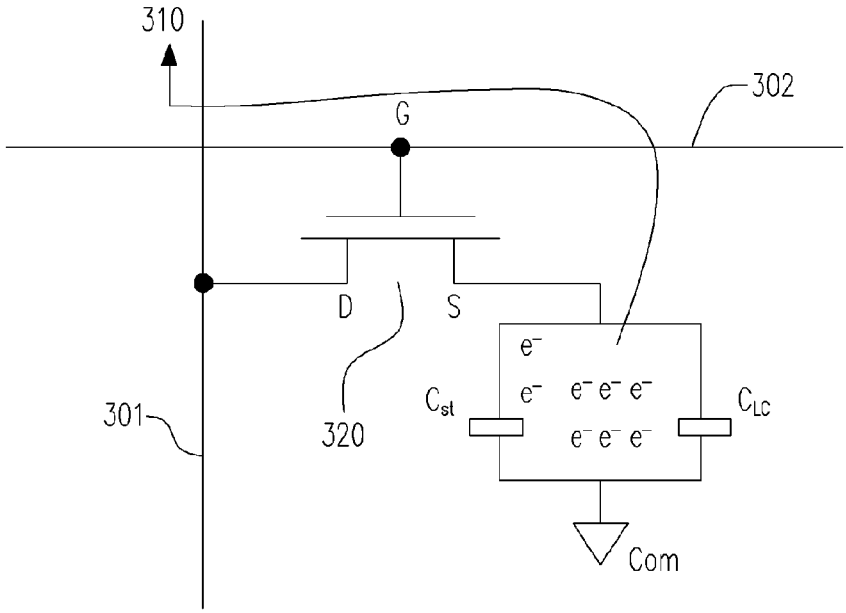
FIG. 3 is a schematic diagram illustrating discharging of a pixel capacitor corresponding to a TFT according to one embodiment of the present invention.
Figure 4:
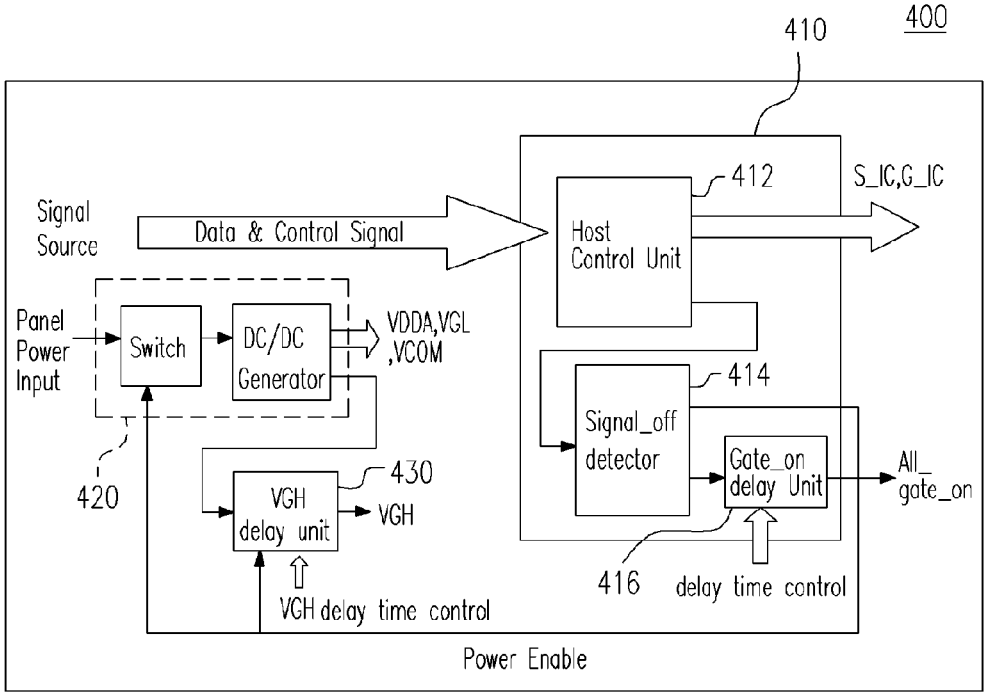
FIG. 4 is a schematic block diagram illustrating an integrated control circuit for resolving image residual phenomenon according to one embodiment of the present invention.

Referring to FIG. 4, a schematic block diagram of a control circuit, according to one embodiment of the present invention is shown. The LCD panel 400 comprises a built-in signal-off detector 414 of an ASIC 410 for detecting status thereof. When the signal-off detector 414 fails to detect a signal from the host control unit 412, the LCD panel system is identified to be in off-state, when an all-gate-on signal is low level enable, and gates of all TFTs are turned on. Referring to FIG. 3, a schematic diagram of discharging the storage capacitor 310 via a source terminal of the TFT 320 using the control circuit according to one embodiment of the present invention is shown. If the source terminal of the TFT 320 does not manage to discharge according to the method of the present invention, i.e. a signal carried on the gate driving line fails to exceed the gate-on threshold voltage level before discharging, transistor is then discharged via source driving line 301 and various discharging speed of distributive transistors on the panel results in residual image caused by unevenness as well as miniature off-leakage current.

Referring to FIG. 4, the control circuit according to one embodiment of the present invention is integrated in an ASIC of an LCD panel, wherein the control circuit includes a signal detecting unit 414 and an all-gate-on delay unit 416. The signal detecting unit 414 is coupled to a host control unit 412 providing two low level enable signals, wherein one is power enable signal DC_DC.ENA coupled to a switch of the power input of the power supply module 420 for switching off the input potential, and also coupled to a VGH delay unit 430 such that the power is turned off by VGH after a delay time for retaining a turn-on threshold voltage of the gate of the TFT. Other voltage sources provided by the power supply, e.g. analog voltage supply, turn-off voltage for transistor and common voltage, are assigned to be turned off when DC_DC.ENA is generated. The signal-detecting unit 414 also transmits an all-gate-on signal for turning on gates of all TFTs, and determining an operative time after a specific time interval when DC_DC.ENA is generated by a gate delay unit.

Figure 5:
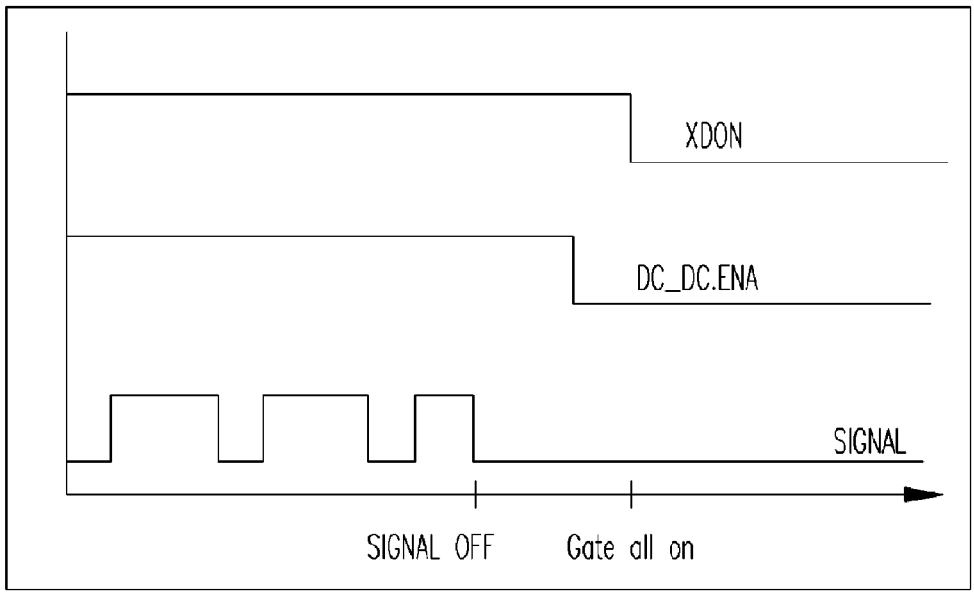
FIG. 5 is a schematic diagram illustrating control signals of the integrated control circuit according to one embodiment of the present invention.
Figure 6:
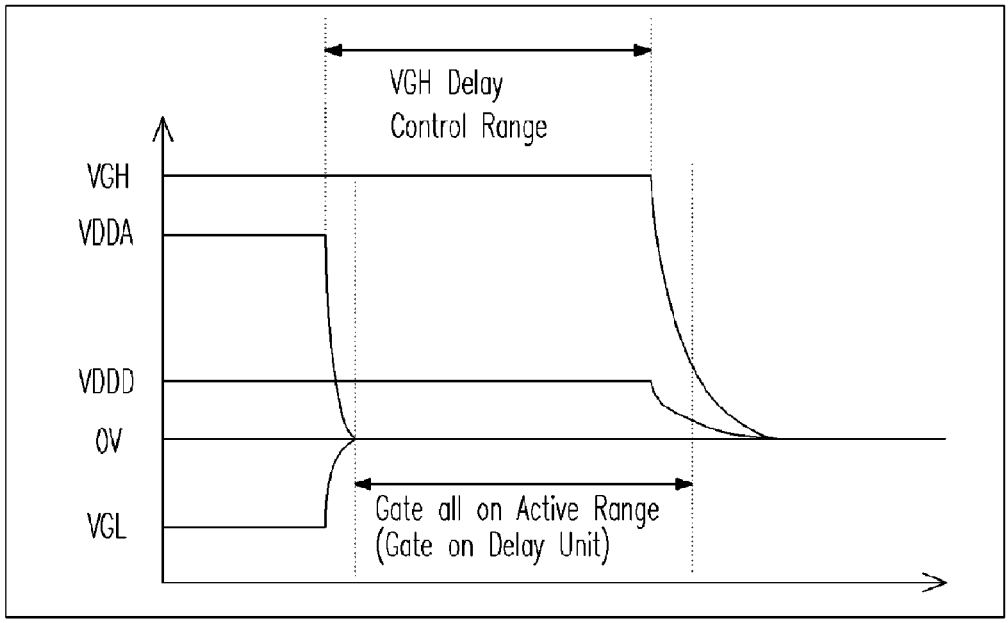
FIG. 6 is a diagram illustrating potential response of a TFT according to one embodiment of the present invention.

In a general LCD panel system, a normal power-off procedure follows the steps of turning off the back light module, the signal providing module and the power supply module. According to power-off timing, in the present embodiment of the present invention, the operation steps are described with reference to FIG. 5 as follows. When the signal DC_DC.ENA is generated, the analog voltage source VDDA, the gate scanning line voltage source VEEG and a common voltage source Vcom are all turned off, which decay to ground voltage level GND with time. Moreover, in order to turn on gates of all TFTs, VGH turn-off time is delayed such that voltage level is high enough for switching on the gates. The time difference between VGH and DC_DC.ENA is determined via VGH delay unit. The time to turn on all gates is after VDDA is reduced to GND, and transistors discharge via source terminal path thereof to achieve rapid charge neutralization. The time to turn on all the gates should be no later than when VGH reaches the minimum threshold voltage for switching on gates of the TFT. Referring to FIG. 6, wherein a start time and an end time of switching on the gate-on signal range are respectively later than a start time and an end time of the VGH delay range.

Although the invention has been described with reference to a particular embodiment thereof, it will be apparent to those skilled in the art that modifications to the described embodiment may be made without departing from the spirit of the invention. Accordingly, the scope of the invention will be defined by the attached claims and not by the above detailed description.

What is claimed is:

1. A control circuit, for an LCD device having a power module, a host control unit, and an image display unit, the power module supplying a plurality of potential levels for the LCD device, the control unit controlling a plurality of gate driving signals and a plurality of source driving signals for the image display unit, the control circuit comprising:

a signal delay unit, coupled to the image display unit; and a signal detecting unit, coupled to the host control unit, wherein the signal detecting unit detects an on/off status of the LCD device from the host control unit, provides a disable signal to the power module, such that the voltage potential levels are disabled except a pixel transistor turning-on level, a plurality of pixel transistors of the image display unit are discharged via sources of the pixel transistors, and provides an all-gate-on signal to the signal delay unit, the all-gate-on signal is delayed for a first delay time by the signal delay unit and outputs to the image display unit.

2. The control circuit as recited in claim 1, wherein the first delay time is before the pixel transistor turning-on level is reduced to a gate threshold voltage, and the second delay time is after an analog voltage source of the LCD device is reduced to a ground level.

3. The control circuit as recited in claim 1, wherein the host control unit, the signal-detecting unit, and the signal delay unit are integrated into an Applied Specific Integrated Circuit (ASIC).

4. A method of discharging pixel transistors of an LCD device, comprising:

detecting whether the LCD device stops displaying an image;

providing a first signal to disable a power module of the LCD device and turn off a pixel transistor turn-on potential level after a first delay time; and providing a second signal to turn on all the pixel transistors after a second delay time.

5. The method as recited in claim 4, further comprising:

assigning a start point of an all-gate-on period of all the pixel transistor after an analog voltage source supplying the LCD device is reduced to a ground voltage level, such that the pixel transistors are discharged via sources thereof within the first delay time; and assigning an end point of the all-gate-on period of all the pixel transistor before the pixel transistor turn-on level reaches to a threshold voltage for turning on the pixel transistors.

6. The method as recited in claim 4, wherein the pixel transistors are fabricated by utilizing Thin Film Transistor (TFT) technology.

7. An Applied Specific Integrated Circuit (ASIC), for a capacitor charging/discharging device, having a plurality of capacitors, comprising:

a host control unit;

a signal detecting unit, receiving a first disable signal outputted from the host control unit and outputting a second disable signal to a power supply module outside of the ASIC, for disabling a part of the power supply module simultaneously, and disabling other part of the power supply module which controls the capacitors after a first delay time; and a delay unit, receiving a second signal from the signal detecting unit, and outputting to the capacitor charging/discharging device after having paused for a second delay time, such that a plurality of switches controlling the capacitors are turned on.

8. An LCD panel system, for operating an LCD panel controlled by at least a plurality of source driving signals and a plurality of gate driving signals, comprising:

a control circuit, outputting a plurality of data and a plurality of control signals;

a pixel array, coupled to the control circuit, having a plurality of pixels arranged in an array, wherein each of the pixels corresponds to a transistor for receiving at least one of the data provided from the control circuit and at least one of the control signals for displaying an image;

a power module, for supplying a plurality of potential levels to the LCD panel and receiving at least a part of the control signals from the control circuit, wherein when the control circuit detects the LCD panel has stopped to display the image, a first signal and a second signal are transmitted, wherein the first signal disables the power module and turns off a pixel transistor turn-on level after a first delay time, and the second signal turns on gates of the transistors corresponding to all of the pixels after a second delay time.

9. The system as recited in claim 8, wherein the transistors are fabricated using film-forming technology of a Thin Film Transistor (TFT).

10. The system as recited in claim 8, wherein the step of turning off the pixel transistor turn-on level after the first delay time comprises using a first delay device.

11. The system as recited in claim 8, wherein the step of turning on the gates of the transistors of all the pixels after the second delay time comprises using a second delay device.

12. The system as recited in claim 8, wherein the first signal indicating all potential levels supplied by the power module except the pixel transistor turn-on level to be turned off.

13. The system as recited in claim 8, wherein the first signal and the second signal are low level enable signals.

14. The system as recited in claim 8, wherein the host control unit, the signal detecting unit and the delay unit are integrated in an Applied Specific Integrated Circuit (ASIC).

* * * * *